US008911058B2

(12) United States Patent
Tanaka et al.

(10) Patent No.: US 8,911,058 B2
(45) Date of Patent: Dec. 16, 2014

(54) RECORDING APPARATUS

(71) Applicant: Seiko Epson Corporation, Tokyo (JP)

(72) Inventors: Daisuke Tanaka, Shiojiri (JP); Minoru Kishigami, Matsumoto (JP); Kazuyoshi Ohashi, Matsumoto (JP); Shota Mizuno, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 103 days.

(21) Appl. No.: 13/631,069

(22) Filed: Sep. 28, 2012

(65) Prior Publication Data

US 2013/0083125 A1 Apr. 4, 2013

(30) Foreign Application Priority Data

Sep. 29, 2011 (JP) ..... 2011-214518

(51) Int. Cl.
*B41J 2/165* (2006.01)
*B41J 25/308* (2006.01)

(52) U.S. Cl.
CPC ..... *B41J 25/3086* (2013.01)
USPC ..... 347/37

(58) Field of Classification Search
None
See application file for complete search history.

(56) References Cited

U.S. PATENT DOCUMENTS

2009/0040252 A1 * 2/2009 Tanaka et al. ..... 347/8

FOREIGN PATENT DOCUMENTS

JP 2004-017314 1/2004
JP 2006-096028 4/2006

* cited by examiner

*Primary Examiner* — Alejandro Valencia
(74) *Attorney, Agent, or Firm* — Workman Nydegger

(57) ABSTRACT

An ink jet printer includes a carriage that includes a recording head which performs recording on a medium and is movable in a scanning direction of the recording head, a first sliding portion that is provided so as to be able to displace a relative position to a carriage main body in a direction in which a gap between the recording head and the medium changes and moves in the scanning direction together with the carriage, a guide member with which the first sliding portion makes contact and that is provided so as to extend in the scanning direction, and a gap adjusting unit that adjusts the gap by adjusting a position of the carriage main body relative to the first sliding portion.

6 Claims, 8 Drawing Sheets

RECORDING APPARATUS

BACKGROUND

1. Technical Field

The present invention relates to a recording apparatus which performs recording on a medium.

2. Related Art

Hereinafter, an ink jet printer as an example of a recording apparatus will be described. The ink jet printer includes a recording head which discharges ink onto recording paper on a carriage. The carriage is guided by a guide member extending in a scanning direction (hereinafter, referred to as "main scanning direction") of the recording head. Further, the carriage is fixed to a part of an endless belt, for example, and is configured to reciprocate in the main scanning direction being pulled by the endless belt.

Generally, a position on the carriage at which the endless belt is fixed and a gravity center position of the carriage cannot be equally matched. Therefore, when the endless belt pulls the carriage, a phenomenon that the carriage tries to rotate (also referred to as "wobbling phenomenon") is generated and ink landing accuracy is lowered in some cases. The carriage wobbles in several wobbling directions. When a paper transportation direction on a recording surface of paper is assumed as a y direction, a direction (paper width direction) orthogonal to the y direction is an x direction, and a direction orthogonal to the recording surface is a z direction, there are cases of a wobbling on an x-z plane, a wobbling on an x-y plane, and the like.

In JP-A-2006-96028, a recording apparatus having the following configuration in order to prevent a carriage from wobbling has been described. That is, in the recording apparatus, a biasing unit which exerts a biasing force between a guide member (guide shaft) and the carriage is provided. Further, a rotation moment in a constant direction is given to the carriage in advance with the biasing unit so as to generate the rotation moment in the constant direction all the time regardless of a movement direction of the carriage, in order for the carriage to prevent from wobbling.

In addition, in JP-A-2004-17314, an image forming apparatus having the following configuration has been disclosed. That is, in the image forming apparatus, in order to suppress looseness between first and second guide members and a carriage, a slide contact surface which makes slide contact with each of the guide members is pressed against the guide members by a biasing member. Note that the first and second guide members are provided along the movement direction of the carriage.

There is an ink jet printer having a configuration in which a gap between a recording head and paper (hereinafter, referred to as "PG") can be adjusted. With the ink jet printer, an appropriate recording result can be obtained regardless of the thickness of paper by adjusting the PG.

Various adjusting mechanisms of adjusting the PG have been proposed. For example, there is an adjusting mechanism which adjusts the PG by changing the height position of a guide member which guides a carriage in the main scanning direction.

As this PG adjusting mechanism, a case in which the PG is adjusted by providing a guide member in a fixed manner and changing a relative position between a sliding member which makes slide contact with the guide member on a carriage and a carriage main body is considered.

With this configuration, the guide member is not required to be displaced and cost of the apparatus can be reduced. However, if the PG is adjusted, the gravity center position of the carriage relative to the guide member and a carriage pulling position (position on the carriage at which an endless belt is fixed) relative to the guide member are changed. Accordingly, the magnitude of a rotation moment (degree of wobbling phenomenon) when the carriage is pulled is also changed with the PG adjustment. Therefore, it is desired to obtain an appropriate wobbling prevention effect regardless of the magnitude of the PG. However, in the above-described existing recording apparatuses, such technical problem has not been taken into consideration.

SUMMARY

An advantage of some aspects of the invention is to provide a recording apparatus which can appropriately suppress wobbling of a carriage even if a PG is changed.

A recording apparatus according to a first aspect of the invention includes a carriage that includes a recording head which performs recording on a medium and is movable in a scanning direction of the recording head, a first sliding portion that is provided so as to be able to displace a relative position to a main body of the carriage constituting the carriage in a direction in which a gap between the recording head and the medium changes and moves in the scanning direction together with the carriage, a guide member with which the first sliding portion makes contact and that receives a weight of the carriage through the first sliding portion and is provided so as to extend in the scanning direction, a gap adjusting unit that adjusts the gap by adjusting a position of the main body of the carriage relative to the first sliding portion, and a second sliding portion that is biased toward the guide member by a biasing member provided at a side of the main body of the carriage and makes slide contact with the guide member at the side opposite to a side with which the first sliding portion makes contact.

According to the aspect of the invention, the recording apparatus includes a configuration in which a relative position between the first sliding portion which makes slide contact with the guide member and the carriage main body is changed so as to adjust a gap (PG). In the recording apparatus, the biasing member for biasing the second sliding portion which makes slide contact with the guide member at the side opposite to the side with which the first sliding portion makes contact is provided on the carriage main body. Therefore, a biasing force generated when the biasing member biases the second sliding portion is changed with change of the PG.

To be more specific, if the PG becomes larger (the carriage main body is farther from the guide member), a distance between a carriage gravity center and the guide member also becomes larger. Therefore, wobbling becomes easy to generate. However, a distance between the carriage main body and the second sliding portion also becomes larger at the same time. Therefore, the biasing member is extended so that the biasing force generated when the biasing member biases the second sliding portion also becomes larger. This increases a wobbling suppression effect. It is to be noted that if the PG becomes smaller, a result opposite to the above-described result is obtained. As described above, according to the aspect of the invention, even if the PG is changed, the carriage wobbling can be appropriately suppressed in accordance with a change amount thereof.

It is to be noted that the biasing member is "provided at a side of the main body of the carriage" indicates that the biasing member is provided at a side of a configuration portion in the carriage, which is displaced relative to the above first sliding portion in a PG adjustment direction. The expression indicates that the biasing member is not limited to be provided on a housing constituting the carriage main body and the biasing member may be provided on another configuration portion (recording head or the like) provided on the carriage main body.

According to a second aspect of the invention, it is preferable that the plurality of second sliding portions be provided along the scanning direction in the first aspect of the invention.

According to the aspect of the invention, the plurality of second sliding portions are provided along the scanning direction. Therefore, the wobbling of the carriage can be addressed at a plurality of places, thereby suppressing the carriage from wobbling more appropriately.

According to a third aspect of the invention, it is preferable that the second sliding portion, the guide member, and the biasing member be made of metal materials and make electrical contact with one another, and the recording head make electrical contact with the biasing member so that the biasing member, the second sliding portion, and the guide member constitute a grounding unit which grounds the recording head in the first or second aspect of the invention.

According to the aspect of the invention, the grounding unit of the recording head is constituted by using a configuration which suppresses the carriage wobbling. Therefore, a dedicated grounding unit of the recording head is not required to be provided, thereby reducing cost and space of the apparatus.

According to a fourth aspect of the invention, it is preferable that at least one of the plurality of second sliding portions, the guide member, and the biasing member be made of metal materials and make electrical contact with one another, the recording head make electrical contact with the biasing member so that the biasing member, the second sliding portion, and the guide member constitute a grounding unit which grounds the recording head, and the second sliding portion which constitutes the grounding unit among the plurality of second sliding portions make contact with the guide member with a biasing force smaller than that of the second sliding portion that does not constitute the grounding unit in the second aspect of the invention.

According to the aspect of the invention, the grounding unit of the recording head is constituted by using a configuration which suppresses the carriage from wobbling. Therefore, a dedicated grounding unit of the recording head is not required to be provided, thereby reducing cost and space of the apparatus. In addition thereto, the second sliding portion which constitutes the grounding unit among the plurality of second sliding portions makes contact with the guide member with a biasing force smaller than that of the second sliding portion that does not constitute the grounding unit in this aspect. Therefore, a risk that grounding resistance is fluctuated due to fluctuation in load can be reduced, thereby realizing grounding appropriately.

According to a fifth aspect of the invention, it is preferable that the biasing member be constituted by a plate spring in any one of the first through fourth aspects of the invention.

According to the aspect of the invention, the biasing member is constituted by a plate spring. Therefore, the biasing member can be configured simply at low cost.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention is described with reference to drawings. However, the invention is not limited to the embodiment, which will be described below, and various variations can be made within the range of the invention as described in the aspects of the invention. Under the assumption that the variations are also encompassed in the range of the invention, the embodiment of the invention will be described below.

Figure 1:
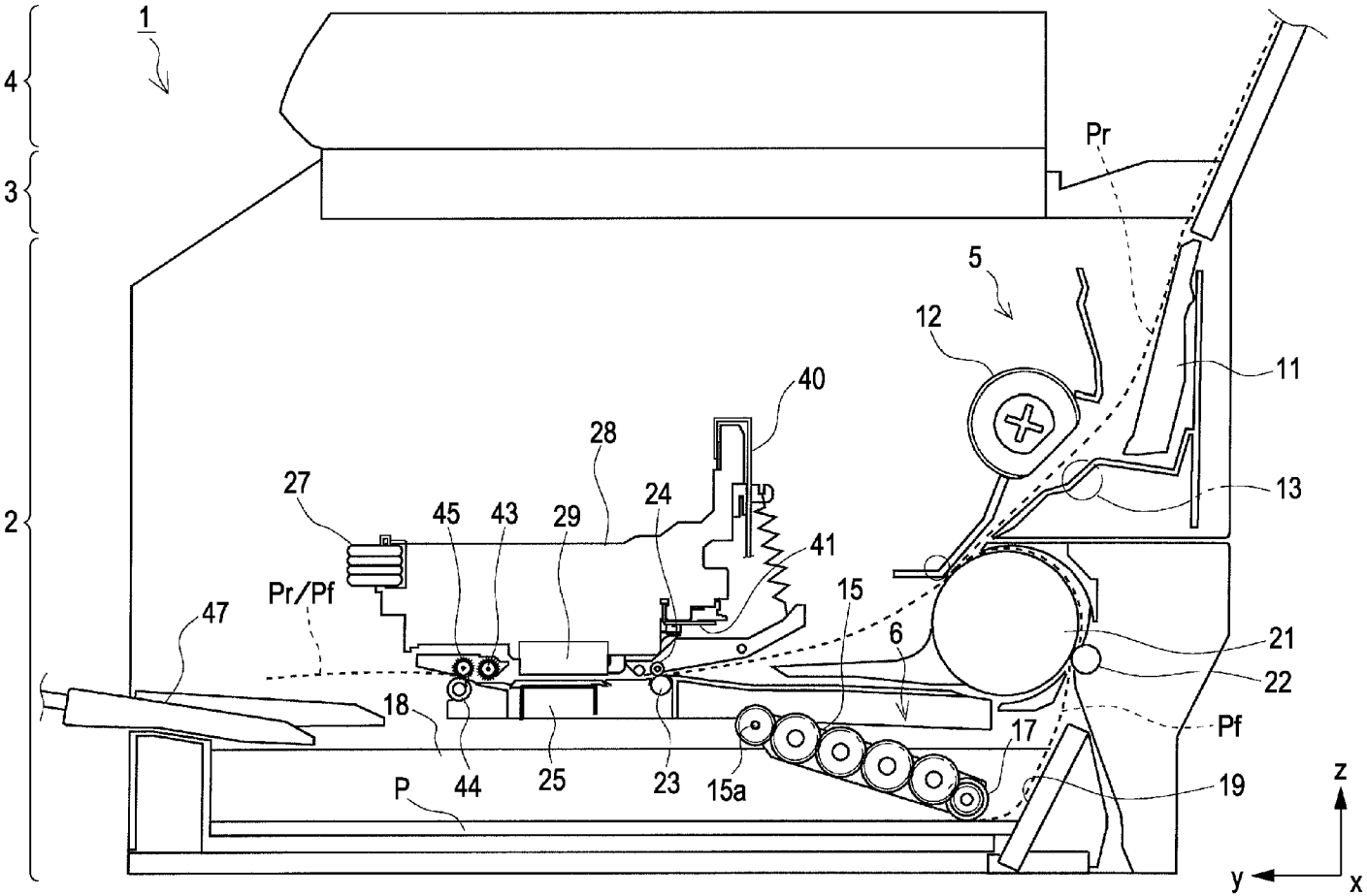
FIG. 1 is a cross-sectional side view illustrating a paper transportation path of a printer according to an embodiment of the invention.
Figure 2:
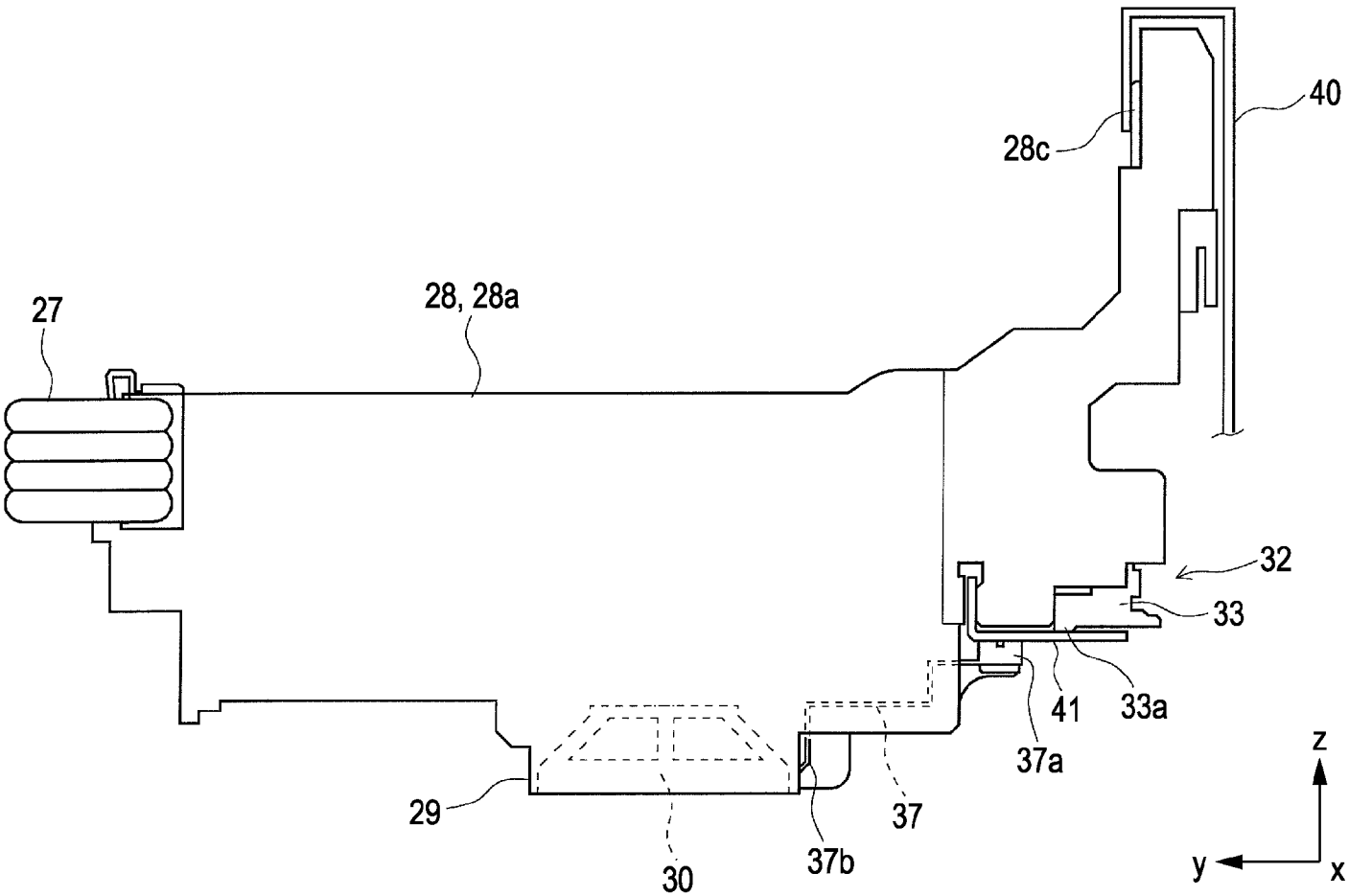
FIG. 2 is a side view illustrating a carriage of the printer according to the embodiment of the invention.
Figure 3:
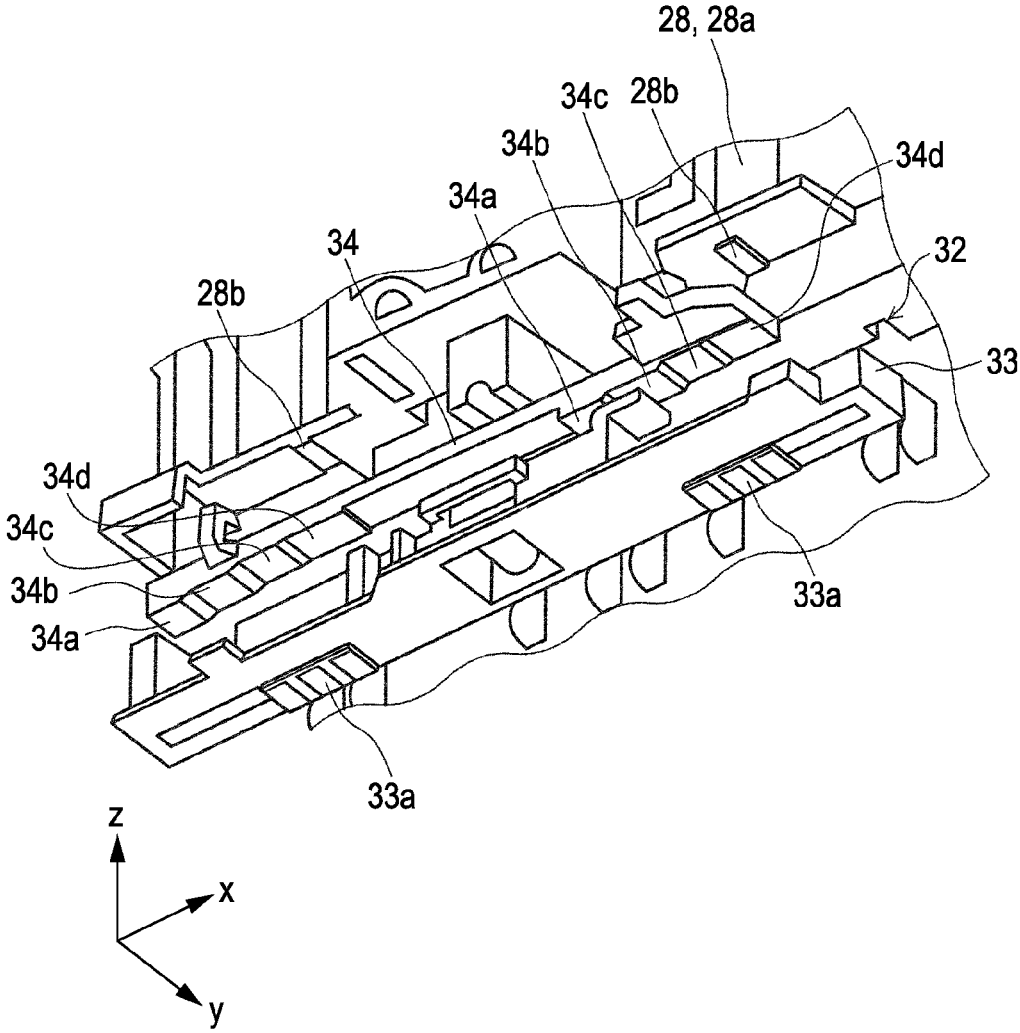
FIG. 3 is an exploded perspective view illustrating a gap adjusting unit.
Figure 4:
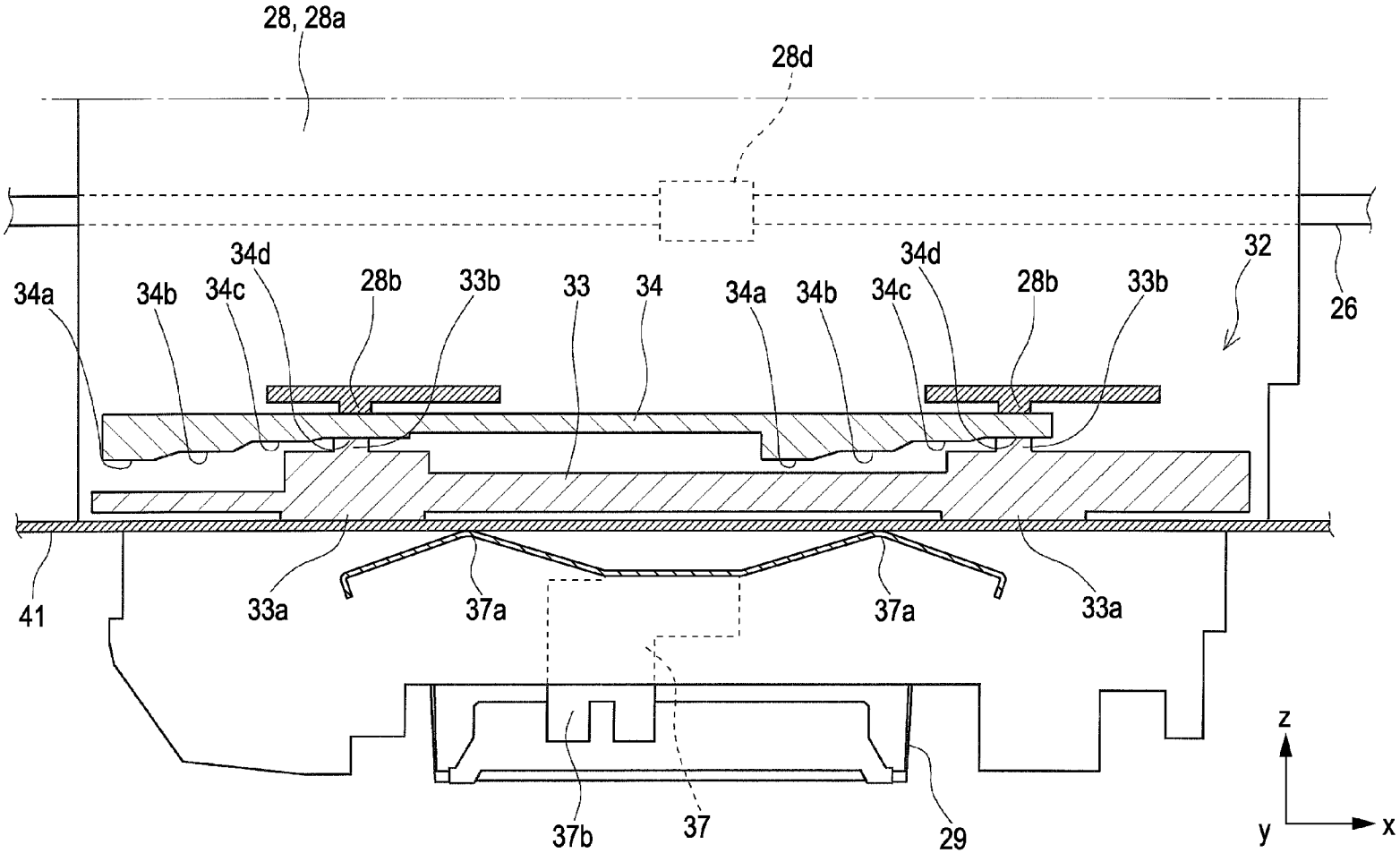
FIG. 4 is a cross-sectional view illustrating the gap adjusting unit.
Figure 5:
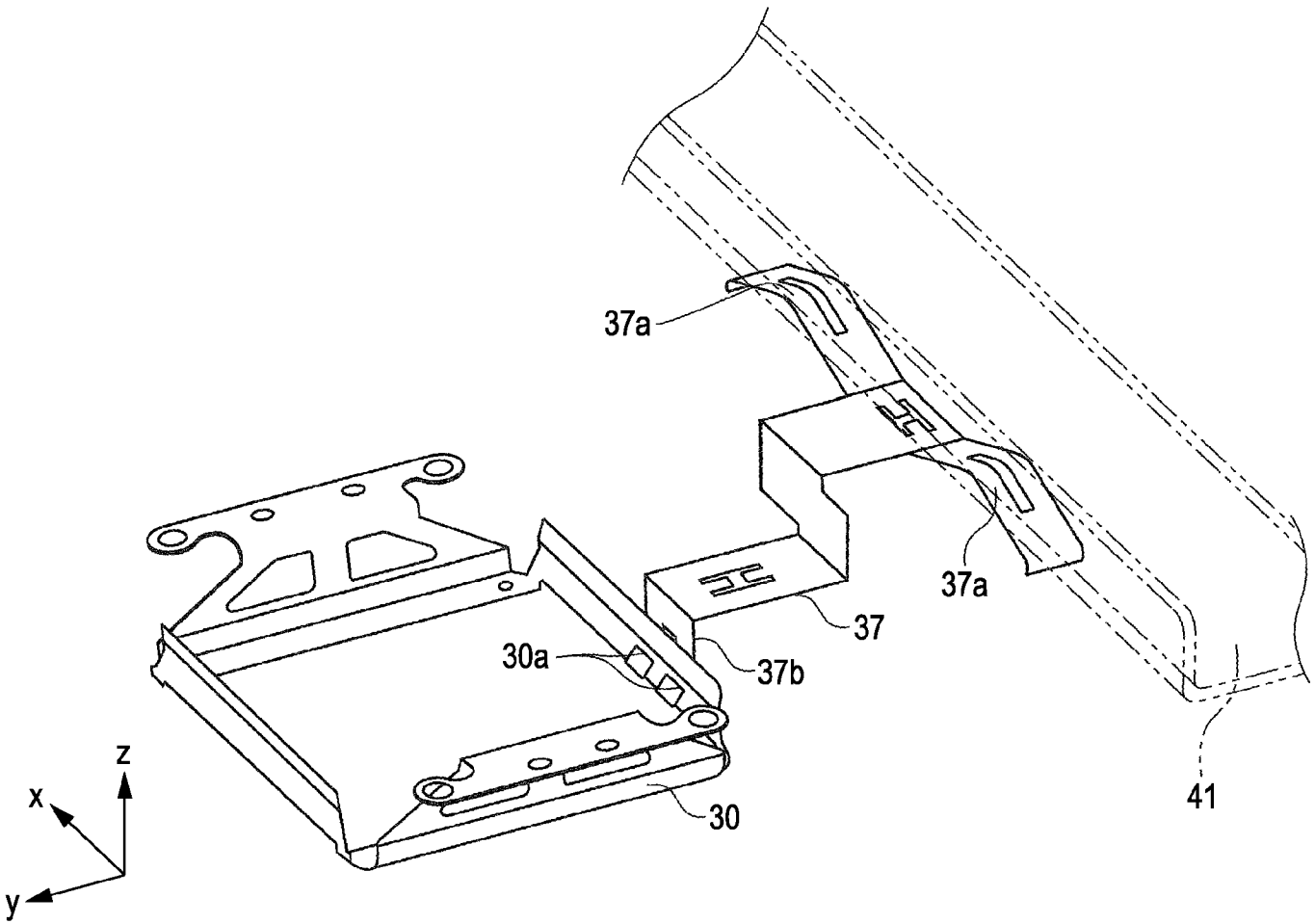
FIG. 5 is a perspective view illustrating a head cover and a plate spring.
Figure 6A:
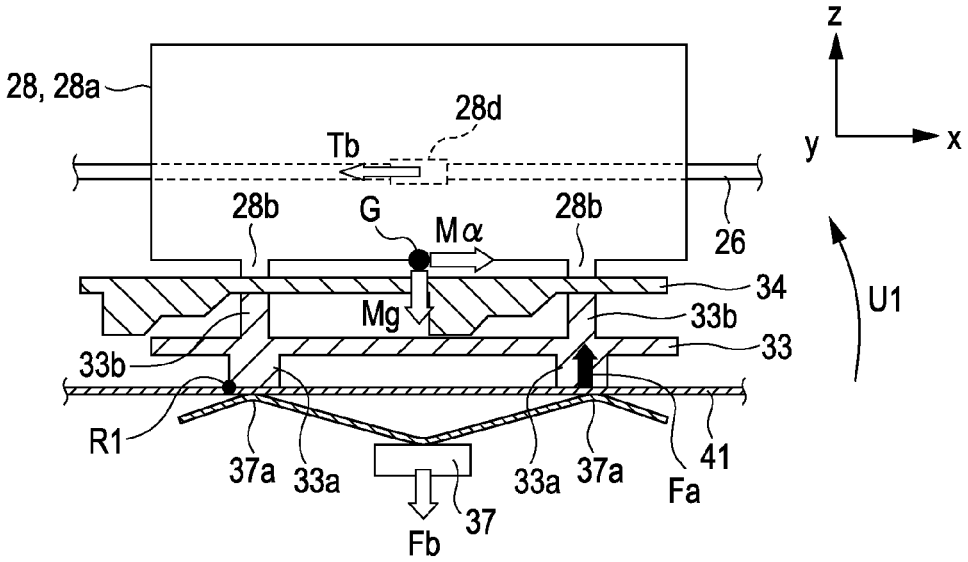
FIGS. 6A and 6B are schematic plan views for explaining a movement direction of a carriage main body and a wobbling direction of the carriage main body.
Figure 6B:
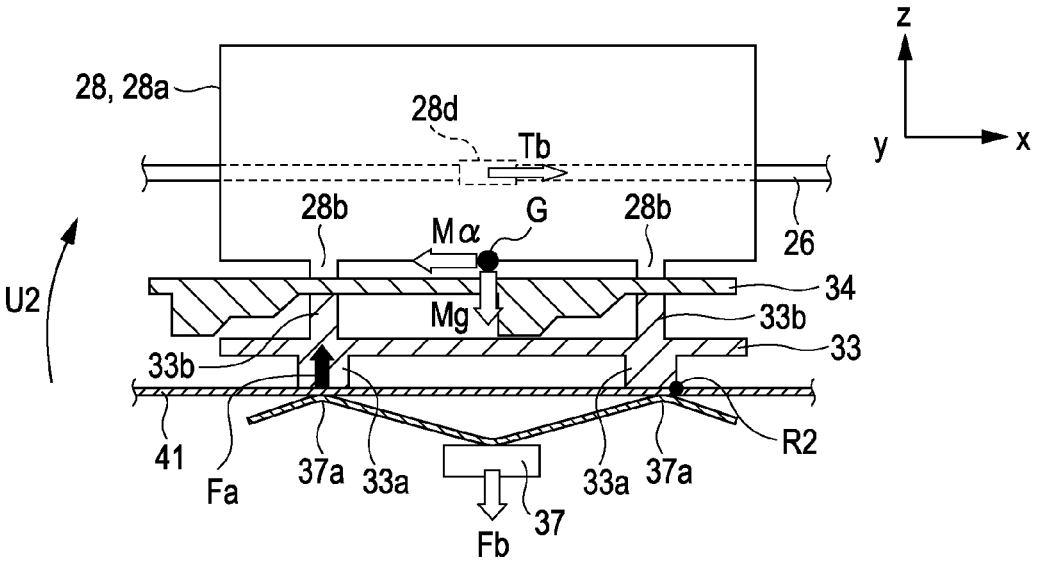
Figure 7A:
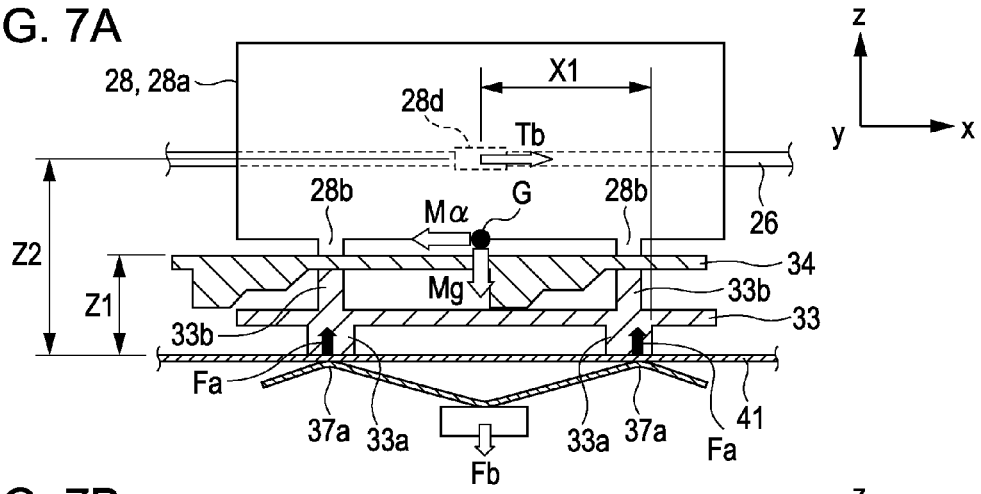
FIGS. 7A to 7C are schematic plan views illustrating change of a positional relationship between the carriage main body and a second guide plate with PG adjustment.
Figure 7B:
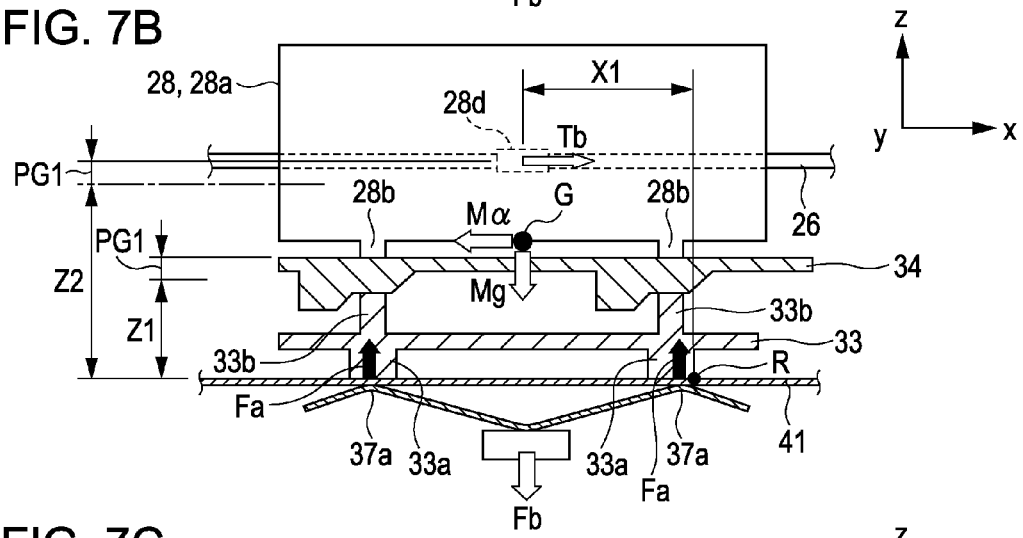
Figure 7C:
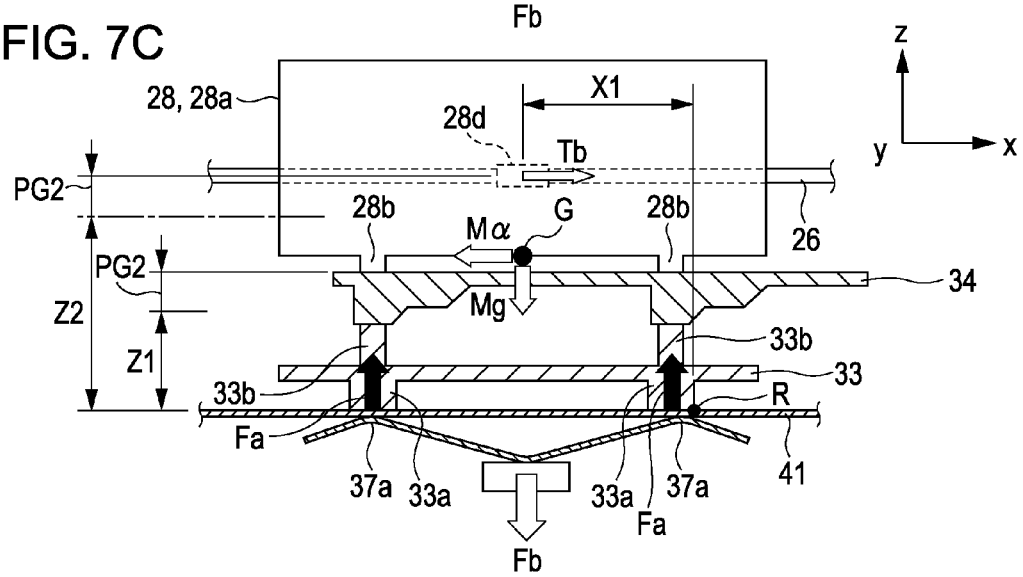
Figure 8:
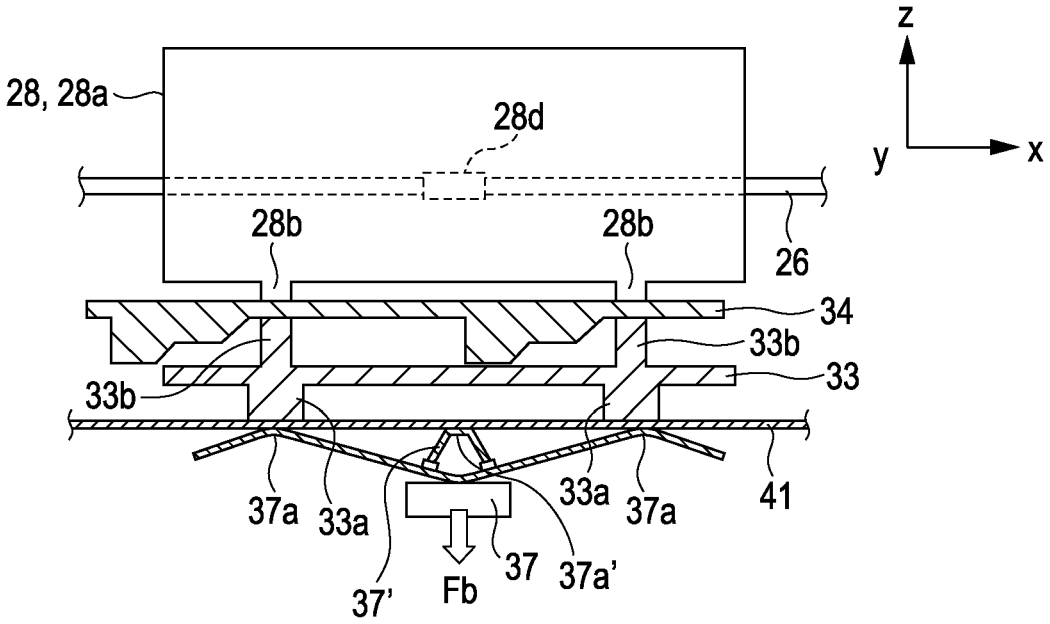
FIG. 8 is a view illustrating another embodiment of a second sliding portion.

FIG. 1 is a schematic cross-sectional side view illustrating a recording apparatus according to the invention, that is an ink jet printer 1 as an example of the recording apparatus. FIG. 2 is a side view illustrating a carriage 28. FIG. 3 is an exploded perspective view illustrating a gap adjusting unit 32. FIG. 4 is a cross-sectional view illustrating the gap adjusting unit 32. FIG. 5 is a perspective view illustrating a head cover 30 and a plate spring 37. Further, in FIGS. 6A and 6B and FIGS. 7A to 7C, configurations of the carriage 28 and the gap adjusting unit 32 are schematically illustrated. FIGS. 6A and 6B are schematic plan views for explaining a movement direction of the carriage 28 and a wobbling direction of a carriage main body 28*a*. FIGS. 7A to 7C are schematic plan views illustrating change of a positional relationship between the carriage main body 28*a* and a second guide plate 41 with PG adjustment. Further, FIG. 8 is a view illustrating another embodiment of a second sliding portion.

It is to be noted that an x-y-z coordinate system in the drawings indicates directions for convenience of description. The z direction indicates a vertical direction (gravity force direction, direction orthogonal to a paper recording surface), the y direction indicates a transportation direction of paper P, and the x direction indicates a direction (main scanning direction, paper width direction) orthogonal to the y direction and the z direction.

Hereinafter, an overall configuration of the ink jet printer 1 is described at first. In FIG. 1, a reference numeral 2 indicates a recording unit which performs ink jet recording on recording paper as an example of a medium, a reference numeral 3 indicates a scanner unit provided at the upper side of the recording unit 2, a reference numeral 4 indicates an auto document transportation unit provided at the upper side of the scanner unit 3. That is to say, the ink jet printer 1 is constituted as a complex machine including a scanner function in addition to an ink jet recording function.

On the lower portion of the apparatus, a reference numeral 18 indicates a detachable paper cassette on which recording paper is set and a reference numeral 47 is a discharged paper receiving tray which receives discharged recording paper.

The recording unit 2 includes two paper feeding paths. One is a paper feeding path from a second paper feeder 6 provided at a lower portion of the apparatus and the other is a paper feeding path from a first paper feeder 5 provided at an apparatus rear side. It is to be noted that a dashed line Pf indicates a passage route of recording paper fed from the second paper feeder 6 and a dashed line Pr indicates a passage route of paper fed from the first paper feeder 5.

On the second paper feeder 6, a feeding roller 17 constituting a paper feeding unit is provided at a position opposed to the paper cassette 18. The feeding roller 17 is axially supported by a roller supporting member (arm member) 15 which can swing about a rotating shaft 15*a*. The feeding roller 17 is provided so as to advance to and retreat from the paper cassette 18 with a swing operation of the roller supporting member 15. The feeding roller 17 rotates while making contact with uppermost recording paper P accommodated in the paper cassette 18 so as to feed the uppermost recording paper P to the downstream side.

The recording paper P fed by the feeding roller 17 is reversed by a reversal roller 21 having a large diameter in a curved manner, and then, reaches a transportation driving roller 23 and a transportation driven roller 24 as a transportation unit. It is to be noted that a reference numeral 22 indicates a separation roller which nips paper with the reversal roller 21 so as to separate the paper.

On the other hand, a supporting member 11 supports recording paper in an inclined posture on the first paper feeder 5 provided at the upper rear portion of the recording unit 2 and swings about the swinging shaft (not illustrated) at the upper portion. With this, the supporting member 11 makes uppermost supported paper contact with a feeding roller 12 in a pressurized manner. The feeding roller 12 rotates to feed the paper which makes contact therewith in the pressurized manner to the downstream side. It is to be noted that a reference numeral 13 indicates a separation roller which nips paper with the feeding roller 12 so as to separate the paper.

The transportation driving roller 23 and the transportation driven roller 24 are a roller pair which feeds recording paper P to the downstream side precisely. An ink jet recording head 29 and a supporting member 25 are arranged so as to be opposed to each other at the downstream side of the roller pair. The supporting member 25 guides the paper to the downstream side.

The recording head 29 is provided at the bottom portion of the carriage 28 which can reciprocate in the direction (paper plane surface-rear direction of FIG. 1: hereinafter, appropriately referred to as "main scanning direction" or "paper width direction") orthogonal to the paper transportation direction. The recording head 29 performs recording by discharging ink onto the recording paper P while moving in the main scanning direction. It is to be noted that in the embodiment, an ink cartridge is not mounted on the carriage 28. Ink is supplied from the ink cartridge which is provided at the side of the printer main body in a fixed and detachable manner to the recording head 29 through an ink tube 27. However, it is needless to say that the invention is not limited to this configuration.

At the downstream side of the recording head 29, a reference numeral 43 indicates a driven roller which prevents the recording paper P from floating, a reference numeral 44 indicates a discharge driving roller which rotates to discharge the recording paper P, and a reference numeral 45 indicates a discharge driven roller which nips the recording paper P with the discharge driving roller 44. The recording paper P on which recording has been performed is discharged toward the discharged paper receiving tray 47 with these roller pairs.

It is to be noted that the ink jet printer 1 does not discharge the recording paper P on which recording has been performed on a surface (first surface) to the discharged paper receiving tray 47 but back-feeds and reverses the recording paper in a curved manner with the reverse roller 21, so that recording on the back surface (second surface) can be performed.

A schematic configuration of the ink jet printer 1 is described as above. Hereinafter, the gap adjusting unit 32 and a biasing member (plate spring 37) unit are described in detail. The gap adjusting unit 32 adjusts a gap (PG) between the recording head 29 and the paper P. The biasing member (plate spring 37) unit suppresses wobbling of the carriage 28.

In FIG. 2, a reference numeral 40 indicates a first guide member and a reference numeral 41 indicates a second guide member. Both of the first guide member 40 and the second guide member 41 have shapes that are elongated in the main scanning direction. When the carriage 28 moves in the main scanning direction, the carriage 28 is guided by the first guide member 40 and the second guide member 41 in the main scanning direction. It is to be noted that the first guide member 40 and the second guide member 41 are made of metal materials in the embodiment.

To be more specific, a sliding portion 28*c* is provided on the upper portion of the carriage 28. The sliding portion 28*c* makes slide contact with the first guide member 40. Further, a slider 33 provided on the carriage 28 makes slide contact with the upper surface of the second guide member 41 as the "guide member". It is to be noted that the first guide member 40 plays a function of stopping rotation of the carriage 28 in the counterclockwise direction in FIG. 2 exclusively. The second guide member 41 plays a function of receiving the weight of the carriage 28 exclusively.

Next, in the carriage 28, the main body 28*a* of the carriage 28 is displaced in the up-down direction (z direction) while keeping a contact state between the sliding portion 28*c* and the first guide member 40 and a contact state between the slider 33 and the second guide member 41 with the gap adjusting unit 32. With this, the PG can be adjusted. That is to say, the gap adjusting unit 32 adjusts the PG by adjusting a position of the carriage main body 28*a* relative to the slider 33 (first sliding portion 33*a*). It is to be noted that in the embodiment, the first guide member 40 and the second guide member 41 are provided in a fixed manner and are not displaced.

In FIG. 3 and FIG. 4, the gap adjusting unit 32 includes the above-described slider 33 and a cam member 34. Both of the slider 33 and the cam member 34 are members which are integrated with the carriage 28 so as to move in the main scanning direction. The cam member 34 is provided on the carriage main body 28*a* so as to be able to displace relative to the carriage main body 28*a* and the slider 33 in the main scanning direction. The cam member 34 is displaced in the main scanning direction so that the PG is changed.

To be more specific, reference numerals 28*b* indicate abutment portions which are integrally provided on the carriage main body 28*a*. The abutment portions 28*b* are made into a state of being placed on the upper surface of the cam member 34. That is to say, the cam member 34 receives the weight of the carriage 28 through the abutment portions 28*b*.

The lower surface of the cam member 34 corresponds to step-like cam surfaces. Reference numerals 34*a*, 34*b*, 34*c*, and 34*d* indicate first abutment portions, second abutment portions, third abutment portions, and fourth abutment portions which constitute the step-like cam surfaces. Further, these abutment portions are configured so as to be supported by supporting portions 33*b* formed at the upper surface side of the slider 33. It is to be noted that the cam surfaces are connected to one another with smooth inclined surfaces so that the cam member 34 can move in the main scanning direction with no hindrance.

Next, first sliding portions 33*a* as "sliding portions" are formed at the lower surface side of the slider 33. The first sliding portions 33*a* make slide contact with the upper surface of the second guide member 41 when the carriage 28 moves.

Subsequently, a reference numeral 26 indicates an endless belt which pulls the carriage 28 in the main scanning direction. The endless belt 26 is wound around a driving pulley and a driven pulley (not illustrated). If the driving pulley is driven by a motor (not illustrated), the endless belt 26 operates and the carriage 28 moves in the main scanning direction. It is to be noted that a reference numeral 28*d* indicates a position (pulled portion) on the carriage main body 28*a* at which the endless belt 26 is fixed.

In the above configuration, the cam member 34 is provided on the carriage main body 28*a* such that the cam member 34 can be displaced relative to the carriage main body 28*a* and the slider 33 in the main scanning direction as described above. Further, the slider 33 is provided on the carriage main body 28*a* so as to move integrally with the carriage main body 28*a* in the main scanning direction but move relatively to the carriage main body 28*a* in the PG adjustment direction (z direction). In other words, the carriage main body 28*a* can be displaced relative to the slider 33 in the PG adjustment direction.

The cam member 34 is made thicker toward the fourth abutment portions 34*d*, the third abutment portions 34*c*, the second abutment portions 34*b*, and the first abutment portions 34*a* in this order. Accordingly, if the cam member 34 is displaced to the right side from a position in FIG. 4 (a state where the PG is the smallest) and abutment portions which abut against the supporting portions 33*b* of the slider 33 change from the fourth abutment portions 34*d* to the third abutment portions 33*c*, the second abutment portions 33*b*, and the first abutment portions 34*a*, the PG is increased in a step manner. On the other hand, if the cam member 34 is moved to the left side in FIG. 4 from a state where the PG is the largest, the PG is decreased in a step manner on the contrary.

It is to be noted that the cam member 34 is slid by an engagement portion (not illustrated) and a carriage movement operation. That is to say, the engagement portion (not illustrated) is provided so as to be able to displace between a position at which the engagement portion can engage with the cam member 34 and a position at which the engagement portion does not engage with the cam member 34 on the reciprocating path of the carriage 28. Further, when the engagement portion (not illustrated) is located at the position at which the engagement portion can engage with the cam member 34, if the carriage 28 moves from this state, the cam member 34 engages with the engagement portion (not illustrated). If the carriage 28 further moves, the cam member 34 is slid relative to the carriage main body 28*a* and the slider 33.

It is to be noted that the sliding movement of the cam member 34 is realized when the carriage 28 moves in a state where the cam member 34 is locked by the engagement portion (not illustrated) in the main scanning direction. Therefore, when the PG is switched, not the cam member 34 but the carriage main body 28*a* and the slider 33 are displaced in the main scanning direction actually.

It is to be noted that a present stage of the PG (first to fourth abutment portions (34*a* to 34*d*) against which the supporting portions 33*b* of the slider 33 abut) can be detected by an increase in a current value of a carriage driving motor (not illustrated), a carriage movement direction, and a carriage movement amount when the carriage 28 is moved. That is to say, whether the PG is the smallest or largest can be determined by the increase in the current value of the carriage driving motor. Further, whether the PG is changed to the larger side or the smaller side can be determined by the carriage movement direction. It is to be noted that the carriage movement amount can be detected by a unit which detects the carriage movement amount (for example, linear encoder: not illustrated).

Next, the plate spring 37 as the biasing member (biasing unit) is described. As described above, the first sliding portions 33*a* make slide contact with the upper surface of the second guide member 41 in a state of receiving the weight of the carriage main body 28*a*. On the other hand, second sliding portions 37*a* make slide contact with the second guide member 41 at the side opposite to the side with which the first sliding portions 33*a* make contact, that is, the lower surface side in a pressurized manner with a biasing force of the plate spring 37.

The second sliding portions 37*a* are constituted by a part of the plate spring 37. In the embodiment, the part of the plate spring 37 is configured to be divided into two directions. With this, two second sliding portions 37*a* are formed as illustrated in FIG. 5.

The side of the plate spring 37, which is opposite to the side at which the second sliding portions 37*a* are formed, is fixed to the recording head 29. To be more specific, a reference numeral 30 in FIG. 5 indicates a head cover which constitutes the recording head 29 and is made of a metal material. An attachment portion 37*b* of the plate spring 37 is fitted into hole portions 30*a* formed on the head cover 30.

In the embodiment, the head cover 30, the plate spring 37, and the second guide member 41 are made of metal materials and make electrical contact with one another. A grounding unit which grounds the recording head 29 is constituted by the head cover 30, the plate spring 37, and the second guide member 41. In this manner, the plate spring 37 also serves as the grounding unit. Therefore, a dedicated grounding unit which grounds the recording head 29 is not required to be provided, thereby reducing cost and space of the apparatus.

Subsequently, action effects of the plate spring 37 attached to the recording head 29 and the second sliding portions 37*a* constituted by a part of the plate spring 37 are described. FIG. 6A illustrates a case where the carriage 28 is pulled in the left direction in FIG. 6A. In this case, a tendency (wobbling) that the carriage main body 28*a* tends to rotate about a position R1 is generated.

In FIG. 6A, a reference numeral M indicates the weight of the carriage 28, a reference numeral a indicates acceleration in the carriage movement direction, a reference numeral g indicates gravity acceleration, and a reference numeral Tb indicates a pulling force of the endless belt 26. Further, a reference numeral G indicates a gravity center position of the carriage 28.

As illustrated in FIG. 6A, when the carriage 28 starts to move in the left direction in FIG. 6A from a resting state, the force Tb tries to make the carriage 28 rotate in the counterclockwise direction in FIG. 6A. Mα and Mg act so as to cancel the force Tb. However, if the force Tb overcomes Mg and Mα, the carriage 28 rotates in the counterclockwise direction in FIG. 6A as indicated by an arrow U1, that is, tries to wobble.

However, the second sliding portions 37*a* make contact with the lower side of the second guide member 41 in a pressurized manner with the biasing force of the plate spring 37 (force Fa). Therefore, a reaction force of the force Fa acts on the recording head 29, that is, the carriage main body 28*a*, as a reaction force Fb. The reaction force Fb is a resistant force against the rotation moment U1.

As illustrated in FIG. 6B, also when the carriage 28 moves in the right direction in FIG. 6B, the carriage 28 tries to rotate about a position R2 as indicated by an arrow U2 in the same manner. However, the second sliding portions 37*a* make contact with the lower side of the second guide member 41 in a pressurized manner with the biasing force of the plate spring 37 (force Fa). Therefore, a reaction force of the force Fa acts on the recording head 29, that is, the carriage main body 28*a*, as a reaction force Fb. The reaction force Fb is a resistant force against the rotation moment U2. Accordingly, with the above-described configuration, the wobbling phenomenon of the carriage 28 is suppressed, thereby obtaining preferable recording quality.

Further, the force Fa generated when the second sliding portions 37*a* make contact with the second guide member 41 changes in accordance with change of the PG. That is to say, the plate spring 37 is provided at the side of the carriage main body 28*a* (in the embodiment, recording head 29) which goes up and down with the PG adjustment. Further, the second sliding portions 37*a* which are constituted by a part of the plate spring 37 make contact in a pressurized manner with the second guide member 41 provided in a fixed manner. Therefore, if the PG changes as illustrated in FIGS. 7A, 7B, and 7C, the force Fa (reaction force Fb) also changes therewith.

To be more specific, FIG. 7A illustrates a state where the PG is the smallest. A reference numeral Z2 indicates a distance between the second guide member 41 and the pulled portion 28*d* in the z direction, and a reference numeral Z1 indicates a distance between the second guide member 41 and the abutment portions 28*b* in the z direction. It is to be noted that a reference numeral X1 indicates a distance between each first sliding portion 33*a* and the pulled portion 28*d* in the x direction (note that the distance X1 is constant regardless of the PG).

If the PG is increased by one step as illustrated in FIG. 7B from FIG. 7A, an amount of change of the PG (PG1) is added to each of the distances Z1 and Z2. Due to this, wobbling becomes easier to be generated on the carriage main body 28*a*. In the same manner, if the PG is further increased by one step as illustrated in FIG. 7C from FIG. 7B, an amount of change of the PG (PG2) is added to each of the distances Z1 and Z2. Due to this, wobbling becomes easier to be generated on the carriage main body 28*a* further.

However, the carriage main body 28*a* and the recording head 29, that is, the attachment portion 37*b* of the plate spring 37, are also moved upward with the increase of the PG. Therefore, the plate spring 37 is compressed so that a spring force is also increased. Further, forces generated when the second sliding portions 37*a* make contact with the second guide member 41 in a pressurized manner are also increased. Accordingly, with the above configuration, even if the PG is changed, the carriage 28 can be appropriately suppressed from wobbling in accordance with a change amount thereof.

In the above-described embodiment, two second sliding portions 37*a* are provided. However, the invention is not limited thereto and one or equal to or more than three second sliding portion(s) 37*a* may be provided. In this case, biasing forces (magnitudes of forces generated when the second sliding portions make contact with the second guide member 41 in a pressurized manner) may be made different among the plurality of second sliding portions.

For example, in another embodiment as illustrated in FIG. 8, a second sliding portion 37*a*' is further provided between the two second sliding portions 37*a*. The second sliding portion 37*a*' is constituted by another plate spring 37'. The plate spring 37' does not constitute a grounding unit which grounds the recording head 29 (is electrically insulated from the plate spring 37). Further, spring forces are adjusted such that the second sliding portions 37*a* located at both sides of the second sliding portion 37*a*', that is, the second sliding portions constituting the grounding unit, make contact with the second guide member 41 with biasing forces smaller than that of the second sliding portion 37*a*' which does not constitute the grounding unit. With this, a risk that grounding resistance is fluctuated due to fluctuation in load can be reduced, thereby realizing grounding appropriately.

It is to be noted that in the embodiment, the abutment portions 28*b*, the supporting portions 33*b*, and the first sliding portions 33*a* are arranged at the same positions on an x-y plane, thereby preventing the cam member 34 and the slider 33 from being deformed.

The entire disclosure of Japanese Patent Application No. 2011-214518, filed Sep. 29, 2011 is expressly incorporated by reference herein.

What is claimed is:

1. A recording apparatus comprising:

a carriage that includes a recording head which performs recording on a medium and is movable in a scanning direction of the recording head;

a first sliding portion that is provided so as to be able to displace a relative position to a main body of the carriage in a direction in which a gap between the recording head and the medium changes and moves in the scanning direction together with the carriage;

a guide member with which the first sliding portion makes contact and that receives a weight of the carriage through the first sliding portion and is provided so as to extend in the scanning direction, wherein the guide member includes a sliding surface that faces to the first sliding portion in a vertical direction;

a gap adjusting unit that adjusts the gap by adjusting a position of the main body of the carriage relative to the first sliding portion, and a second sliding portion that is biased toward the guide member by a biasing member provided at a side of the main body of the carriage and makes slide contact with the guide member at the side opposite to a side with which the first sliding portion makes contact, wherein the biasing member biases the second sliding portion in the vertical direction, wherein the second sliding portion, the guide member, and the biasing member are made of metal materials and make electrical contact with one another, and the recording head makes electrical contact with the biasing member so that the biasing member, the second sliding portion, and the guide member constitute a grounding unit which grounds the recording head.

2. The recording apparatus according to claim 1, wherein the second sliding portion is provided along the scanning direction.

3. The recording apparatus according to claim 2, wherein at least one of the plurality of second sliding portions, the guide member, and the biasing member are made of metal materials and make electrical contact with one another, the recording head makes electrical contact with the biasing member so that the biasing member, the second sliding portion, and the guide member constitute a grounding unit which grounds the recording head, and the second sliding portion which constitutes the grounding unit among the plurality of second sliding portions makes contact with the guide member with a biasing force smaller than that of the second sliding portion that does not constitute the grounding unit.

4. The recording apparatus according to claim 1, wherein the biasing unit is constituted by a plate spring.

5. The recording apparatus according to claim 1, wherein the gap adjusting unit is composed by carriage movement operation in the scanning direction.

6. A recording apparatus comprising:

a carriage that includes a recording head which performs recording on a medium and is movable in a scanning direction of the recording head;

a first sliding portion that is provided so as to be able to displace a relative position to a main body of the carriage in a direction in which a gap between the recording head and the medium changes and moves in the scanning direction together with the carriage;

a guide member with which the first sliding portion makes contact and that receives a weight of the carriage through the first sliding portion and is provided so as to extend in the scanning direction, wherein the guide member includes a sliding surface that faces to the first sliding portion in a vertical direction;

a gap adjusting unit that adjusts the gap by adjusting a position of the main body of the carriage relative to the first sliding portion, and a second sliding portion that is biased toward the guide member by a biasing member provided at a side of the main body of the carriage and makes slide contact with the guide member at the side opposite to a side with which the first sliding portion makes contact, wherein the second sliding portion is provided along the scanning direction, wherein the biasing member biases the second sliding portion in the vertical direction, wherein at least one of the plurality of second sliding portions, the guide member, and the biasing member are made of metal materials and make electrical contact with one another, the recording head makes electrical contact with the biasing member so that the biasing member, the second sliding portion, and the guide member constitute a grounding unit which grounds the recording head, and the second sliding portion which constitutes the grounding unit among the plurality of second sliding portions makes contact with the guide member with a biasing force smaller than that of the second sliding portion that does not constitute the grounding unit.

* * * * *